United States Patent [19]

Muhr et al.

[11] 4,216,905

[45] Aug. 12, 1980

[54] CLIP-TYPE RAIL FASTENER

[75] Inventors: Karl-Heinz Muhr, Attendorn; Horst Willwacher, Daaden, both of Fed. Rep. of Germany

[73] Assignee: Muhr und Bender, Attendorn, Fed. Rep. of Germany

[21] Appl. No.: 924,714

[22] Filed: Jul. 14, 1978

[30] Foreign Application Priority Data

Jul. 16, 1977 [DE] Fed. Rep. of Germany ..... 2732250

[51] Int. Cl.[2] ..... E01B 9/30

[52] U.S. Cl. ..... 238/349; 238/338

[58] Field of Search ..... 238/310, 315, 338, 349

[56] References Cited

U.S. PATENT DOCUMENTS

| | | | |
|---|---|---|---|
| 3,640,460 | 2/1972 | Baseler | 238/349 |
| 3,690,551 | 9/1972 | Munch | 238/349 |
| 4,073,435 | 2/1978 | Miller | 238/349 |

FOREIGN PATENT DOCUMENTS

| | | | |
|---|---|---|---|
| 207828 | 8/1955 | Australia | 238/349 |
| 1305871 | 2/1973 | United Kingdom | 238/349 |

*Primary Examiner*—John J. Love
*Assistant Examiner*—Ross Weaver
*Attorney, Agent, or Firm*—Karl F. Ross

[57] ABSTRACT

A railroad rail is secured to a support normally constituted by a rail-fastening plate by means of a bolt engaged in this plate and a clip pressed by the bolt downwardly on one side against the plate and on the other side against the flange of the rail. To this end the clip is unitarily formed from a single piece of steel wire with a support leg that rests on the support and has one end connected via a bight extending over a ridge on the support to a bearing leg that bears on the flange of the rail. The other end of the support leg is extended to form an eye through which the bolt passes and the wire forming this clip has a bent-down end at the eye that limits the tightening of the bolt by abutment with the top of the ridge. Thus the support leg is twisted about its straight axis when the fastener is tightened for torsional loading.

10 Claims, 4 Drawing Figures

FIG. 1
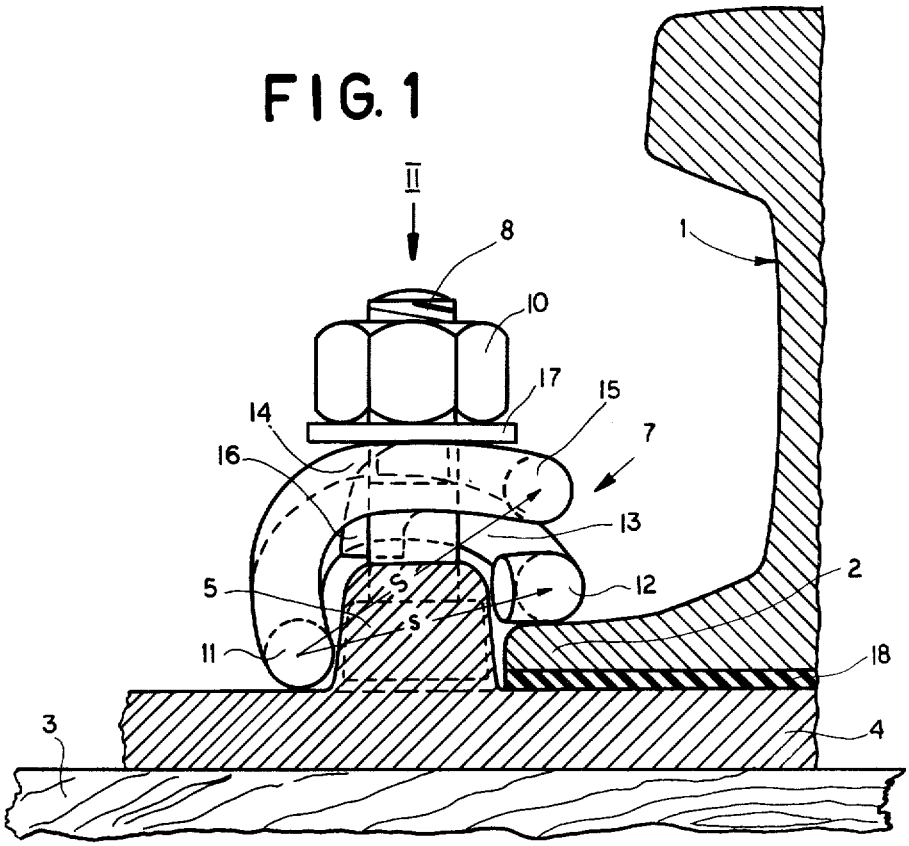
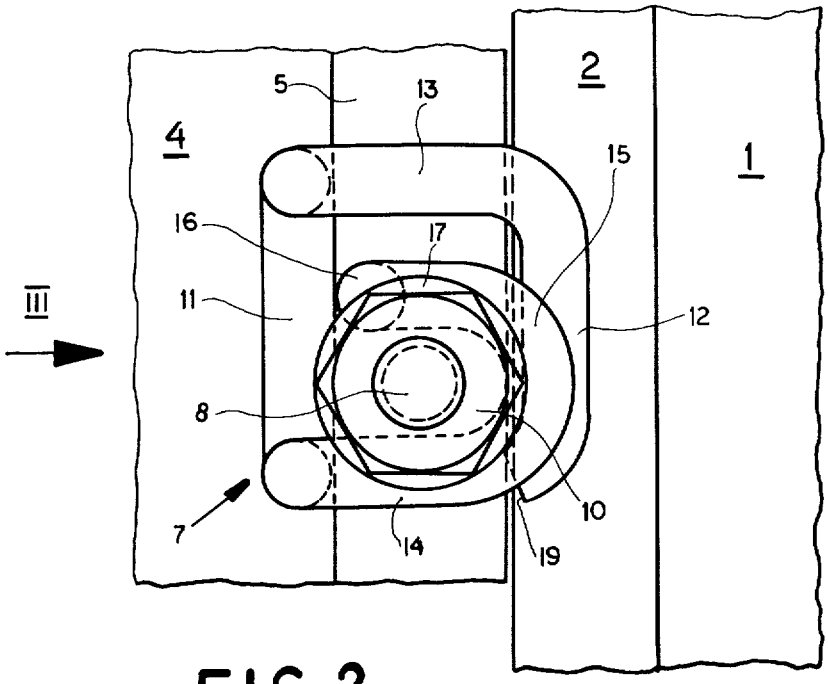
FIG. 2

CLIP-TYPE RAIL FASTENER

FIELD OF THE INVENTION

The present invention relates to an assembly for securing a railroad rail to a railroad tie.

BACKGROUND OF THE INVENTION

Instead of simply spiking the flange of a railroad rail to a railroad tie, it is now considered better practice in at least high-stress locations such as curves to secure the rail via a rail-fastening plate and blots to the railroad tie. To this end there is provided at each tie under the rail a so-called saddle or rail-fastening plate having ridges that closely flank the flange of the rail. These fastening plates, which constitute with the ties supports for the rails, are normally permanently spiked into the ties. Bolts and rail clips then secure the flanges of the rails to these plates, so that exact and secure positioning of the rails on the rail-fastening plates is insured. To this end each of the plates is normally provided at its ridges with upwardly open notches that are dimensioned so that the heads of the bolts can simply be slipped laterally into them, but so that the bolts cannot be pulled vertically out.

In the simplest systems the bolt is provided with a washer that overreaches the edge of the flange to secure same tightly to the fastening plate. Although the system has the considerable advantage of simplicity, it does have the disadvantage that the enormous stresses exerted on the bolt fastening can often lead to its loosening, as there is virtually no possibility for displacement of the rail relative to the plate without damage to or loosening of the bolt fastening.

To this end the above-mentioned clips are provided on the heads of the bolts, such as described in German Pat. Nos. 1,053,016, 1,126,901, and 1,246,005. Such systems incorporate springs between the bolt and the rail flange, so that a tensioning force of approximately 1200 daN is achieved with a relative displacement of approximately 15 mm. Such systems nonetheless are typically relatively difficult to assemble, e.g. requiring the use of special tools. In particular torquing the bolt down for the desired spring force requires particular equipment and expert labor.

It is also known from German Pat. Nos. 1,261,151 and 1,954,008 (whose U.S. equivalent is U.S. Pat. No. 3,690,551) to use a W-shaped clip. The central loop of this clip is formed into an eye through which the bolt passes. The two flanking loops are bent down and act as support feet that bear on the fastening plate. The ends of the W-shaped clip are bent down and in and bear resiliently on the edge of the flange. As the portions of the W-shaped clip embrace the ridge of the fastening plate, the tendency for the clip to twist when the bolt is tightened is somewhat reduced.

The disadvantage of this last-described system is that it is relatively difficult to obtain the desired spring force uniformly with a multiplicity of such fasteners. The bolts must be meticulously torqued, and even so the spring force only remains relatively uniform over a very small spring displacement. What is more the reliance almost completely on bending stresses for the spring force results in quick fatigue of the unit, while at the same time the clip must be relatively heavily dimensioned to obtain the required relatively large spring force.

OBJECTS OF THE INVENTION

It is therefore an object of the present invention to provide an improved railroad-rail fastening assembly.

Another object is to provide an improved clip for such an assembly.

Yet another object is to provide such an assembly which uses a clip that can be installed with relative ease, and with conventional tools.

SUMMARY OF THE INVENTION

These objects are attained according to the instant invention in a rail-fastening assembly of the above-described general type having a clip that is unitarily formed with a support leg having a pair of ends and resting on the support, a bearing leg having a pair of ends and resting on the flange of the rail, a bight extending between one end of the support leg and a corresponding one end of the bearing leg, and an eye at the other end of the support leg and overlying the bearing leg. In accordance with the instant invention the legs are generally straight and parallel and the screw or bolt passes through the eye so as to bear on the clip at the eye.

Thus the two legs of the clip are only connected at one end of the clip via the bight that prevents twisting of the clip on the rail-fastening plate. Thus the support leg, which is connected at one end to the eye and at the other end via the bight to the bearing leg, acts as a torsion bar. Since this support leg extends the full length of the clip it is therefore possible for it to exert considerable spring force even when the clip is constructed of relatively light rod material and when it is made relatively small. As the bolt or screw is tightened the eye is moved downwardly toward the bearing leg and the support leg is twisted with a corresponding storage of spring force in it.

According to the features of this invention the support leg is substantially straight and of round section so that it bears in line contact with the support along the full length of the clip measured in a direction parallel to the rail. The bearing leg is generally straight, and is according to this invention inclined slightly relative to the support leg in an unstressed condition of the clip, downwardly from the bight. Thus in spite of the asymmetrical construction the resulting tension force is effective at the center of the tie so that the bending line of the rail being fastened is not changed by the type of fastening. This bearing leg is also slightly curved, convex toward the flange of the rail. The bearing leg may also be slightly curved when seen in top view and concave toward the support leg so that the bearing leg makes point contact with the flange for exact transmission of the spring forces to this flange.

According to further features of this invention the rod forming the clip is formed with a downwardly directed hook at the one end of the eye whose other end is attached to the other end of the support leg. This hook is bent and dimensioned so that it abuts the ridge of the support when the screw has been turned down enough to deform the clip so that the desired spring force is set in the clip automatically when the screw has been turned down to a point where this hooked end engages against the plate. Thus it is not necessary for a highly qualified worker using a torque wrench to tighten down the various screws. Instead it is merely possible using a standard railroad spanner to tighten the screw or bolt down until the hooked end is in contact with the ridge of the fastening plate, at which time the correct spring force will be set in the clip.

An advantage of the fastening assembly according to the instant invention is that it allows limited tipping of the rail on the support, as is for instance necessary at curves. Indeed the rail can tip up somewhat and will automatically return into its original position without any damage to the fastening or permanent loosening thereof. Since the eye overlies the bearing leg, however, a limit will be placed to this upward movement so that it will be impossible for the rail to work completely free of the fastener. For the first part of the lifting operation the bearing leg will merely move upwardly with corresponding torsional deformation of the support leg. Once the bearing leg comes into contact with the lower side of the eye, however, resistance to further displacement increases enormously, with the fastener thereby resisting further displacement with a much greater force. The extent of displacement is, once again, determined by the relative positions of the eye and bearing leg which are in turn determined by the size of the hooked end of the clip.

According to further features of the this invention the eye through which the bolt or screw engages extends in the same rotational sense as the tightening direction of the bolt, and the free end of the bearing leg bears against the one side of the ridge of the fastening plate. This insures that during tightening the clip will not be able to twist around on the fastening plate and that it will be possible to mount the assembly together using a single hand. The entire support leg lies against one side of the ridge and on the other side the free end of the bearing leg bears on this ridge in such a manner that during tightening at least twisting of the clip on the fastening plate is ruled out. The eye lies between the ends of both of the legs so that the effective lever arm is relatively short.

Thus not only does the clip according to this invention have a relatively simple construction that allows it to be produced at low cost, but it can also be made of a relatively short length of relatively thick rod material. As a result of this thickness the effects of corrosion will hardly be seen in the spring force exerted by the clip even over long periods of time. The clip according to this invention is particularly suitable for so-called K-type rail fastening systems employing rail-fastening plates having ridges that flank the rail, but is not limited to this type of fastening system.

BRIEF DESCRIPTION OF THE DRAWING

FIG. 1 is a vertical section through a rail-fastening assembly according to this invention;

FIGS. 2 and 3 are top and side views taken respectively in the direction of arrows II and III of FIGS. 1 and 2.

SPECIFIC DESCRIPTION

Figure 3:
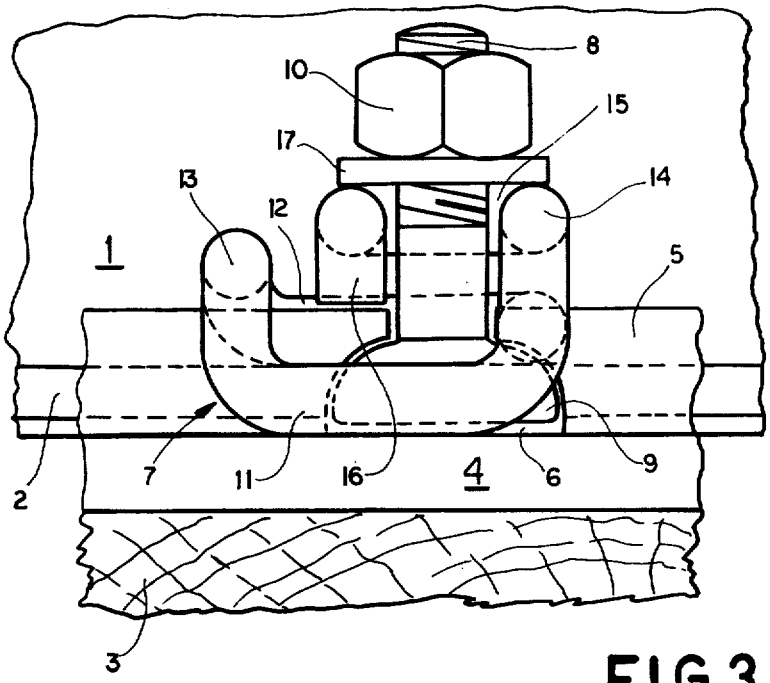

As is shown in FIGS. 1-3 the rail-fastening assembly according to this invention is adapted to secure a railroad rail 1 having a flange 2 to a railroad tie 3. A rail-fastening plate 4 is formed with a ridge 5 extending parallel to the flange 2 and formed with a cutout 6 of dovetail or otherwise upwardly tapered shape. A spring clip 7 is secured by means of a bolt 8 having a heat 9 fitted in the notch 6 and a nut 10 bearing via a washer 17 on the clip 7. One such plate 4 is provided at each of the ties 3 and an elastomeric cushioning sheet 18 is provided between the flange 2 and the plate 4.

Figure 4:
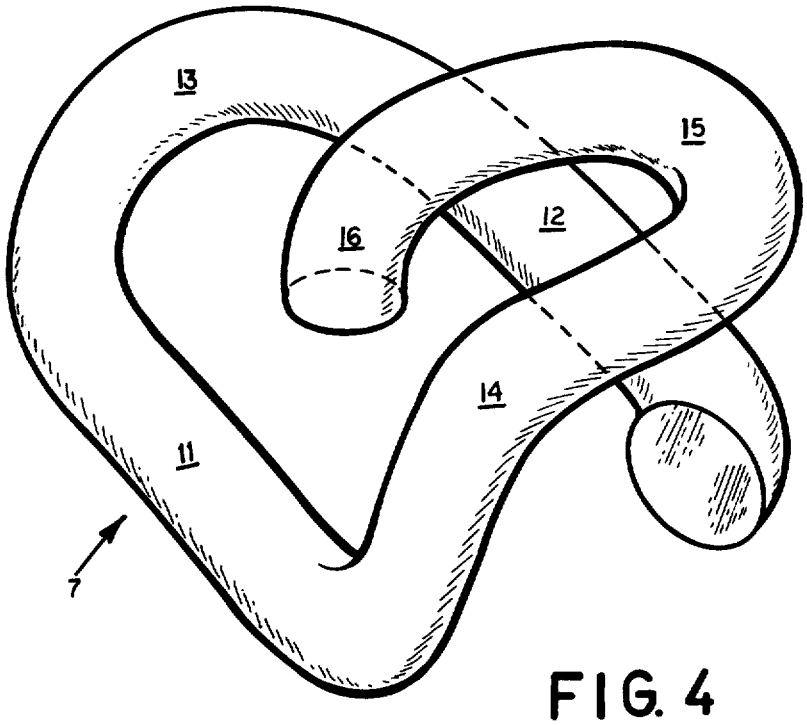
FIG. 4 is a perspective view of the clip according to this invention.

As shown in more detail in FIG. 4 the clip 7 is formed of a piece of round-section steel rod and has a straight support leg 11 that rests on the plate 4 and it is joined to a bearing leg 12 resting on the flange 2 by means of a bight 13 that extends over the ridge 5. At its other end the support leg 11 is joined via another bight or connecting portion 14 to an eye 15 that lies above the ridge 5 and that terminates at an end 16 that in the stressed condition of the clip 7 bears against the top of the ridge 5.

The support leg 11 is perfectly straight and lies in the corner between the ridge 5 and the plate 4 when the nut 10 is screwed down. Therefore, the eye 15 will be moved downwardly and deformation of the clip 7 will be effective almost entirely as torsional deformation of the leg 11 between the bights or connecting portions 13 and 14. This torsional force therefore is effective as a downward force exerted by the leg 12 on the top of the flange 2. The amount of deformation is determined by the dimension of the hooked-over end 16 of the clip 7. According to this invention the bolt 8 is tightened until this end 16 abuts flatly against the top of the ridge 5, thereby exactly establishing the desired deformation, since the dimensions of the flange 2, plate 4, and ridge 5 are all standard and lie within respective relatively small ranges. Furthermore the end 19 of the leg 12 bears against the opposite side of the ridge 5 to hold the clip 7 tightly in place even prior to tightening of the nut 10.

Should the rail 1 tip so as to deform the clip 7 by moving the bearing leg 12 upwardly, this action will merely result in increased torsional loading of the leg 11. When, however, the top of the leg 12 comes into contact with the eye 15 the resistance to further displacement will increase greatly, so that further tipping of the rail 1 will be almost impossible. This action prevents freeing of the rail 1 from the fastening, even at the expense of limiting displacement beyond a certain point, since such freeing could result in a dangerous derailment.

Although the leg 11, as described above, is perfectly straight, the leg 12 is curved both downwardly toward the flange 2 and laterally toward the leg 11. This means that the leg 12 lies in point contact with the flange 2. Furthermore in an unstressed condition the leg 12 extends generally along a line inclined slightly downwardly from the bight 13 toward the end 19 relative to the leg 11.

The eye 15 lies between the connecting portions 13 and 14 and extends from the connecting portion 14 in such a direction that when the right-hand screw 8 is tightened the tendency of the clip 7 to turn with the nut 10 is countered by the contacting of the end 19 of the leg 12 against the side of the ridge 5. Aside from this contact at the end 19, however, the leg 12 lies almost completely out of contact with the ridge 5 to prevent the system from binding when in use.

Furthermore according to this invention the spacing s between the support leg 11 and the bearing leg 12 is smaller than the spacing S between the support leg 11 and the far side of the eye 15. This insures torsional loading over a relatively long distance and a relatively long lever arm for minimum metal fatigue.

We claim:

1. An assembly for fastening a rail to a support, said assembly comprising:

a clip unitarily formed with a single support leg having a pair of ends and resting on said support a single bearing leg having a pair of ends and resting on the flange of said rail, said legs being generally parallel, a bight extending between one end of said support leg and the corresponding one end of said bearing leg, and an eye at the other end of said support leg, between said legs and the ends thereof, and overlying said bearing leg; and a screw secured in said support, passing through said eye between said legs and the ends thereof, and bearing on said clip only at said eye.

2. The assembly defined in claim 1 wherein said support leg is substantially straight and bears over substantially all of its length in at least line contact on said support.

3. The assembly defined in claim 2 wherein in an unstressed condition of said clip said bearing leg is inclined slightly relative to said support leg downwardly from its said one end.

4. The assembly defined in claim 3 wherein in an unstressed condition of said clip said bearing leg is bowed and is convex toward said flange.

5. The assembly defined in claim 4 wherein said bearing leg is bowed toward said support leg.

6. The assembly defined in claim 3 wherein said eye has a pair of ends one of which is fixed at said other end of said support leg and the other of which is formed with a downwardly projecting hook portion spaced from said support in an unstressed condition of said clip and engaging said support in a stressed condition of said clip.

7. The assembly defined in claim 3 wherein said support leg is closer to said bearing leg than to the side of said eye farthest from said support leg.

8. The assembly defined in claim 3 wherein said screw is rotatable in a predetermined rotational sense relative to said support to tighten said clip and said eye extends in said sense from said other end of said support leg.

9. The assembly defined in claim 3 wherien said support is formed adjacent and generally parallel to said flange with a ridge between said legs, said bight extending over said ridge.

10. The assembly defined in claim 3 wherein said clip is unitarily formed of a piece of resilient steel bar.

* * * * *